US008223081B2

(12) United States Patent
Tu

(10) Patent No.: US 8,223,081 B2
(45) Date of Patent: Jul. 17, 2012

(54) SLOT ANTENNA

(75) Inventor: Hsin-Lung Tu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 380 days.

(21) Appl. No.: 12/641,576

(22) Filed: Dec. 18, 2009

(65) Prior Publication Data

US 2010/0321264 A1 Dec. 23, 2010

(30) Foreign Application Priority Data

Jun. 18, 2009 (CN) ..... 2009 1 0303410

(51) Int. Cl.
*H01Q 13/10* (2006.01)

(52) U.S. Cl. ..... 343/767; 343/769

(58) Field of Classification Search ..... 343/767, 343/769, 846

See application file for complete search history.

(56) References Cited

U.S. PATENT DOCUMENTS

| | | | | |
|---|---|---|---|---|
| 5,966,096 | A * | 10/1999 | Brachat | 343/700 MS |
| 6,828,942 | B2 * | 12/2004 | Louzir et al. | 343/769 |
| 7,375,684 | B2 * | 5/2008 | Thudor et al. | 343/700 MS |
| 7,986,278 | B2 * | 7/2011 | Wu | 343/767 |
| 2006/0132359 | A1 | 6/2006 | Chang et al. | |

* cited by examiner

*Primary Examiner* — Tan Ho
(74) *Attorney, Agent, or Firm* — Altis Law Group, Inc.

(57) ABSTRACT

A slot antenna located on a substrate with a first surface and a second surface opposite to the first surface includes a feeding portion, a grounding portion and a radiating portion. The feeding portion is located on the first surface of the substrate to feed electromagnetic signals. The grounding portion is rectangular and located on the second surface of the substrate, and defines a circular clearance in a substantial center portion thereof. The radiating portion is located on the second surface of the substrate and comprises at least one elongated microstrip with one end connected to the grounding portion and the other end extending towards the center of the circular clearance, wherein the feeding portion interacts with the radiating portion to transmit the electromagnetic signals.

9 Claims, 7 Drawing Sheets

SLOT ANTENNA

BACKGROUND

1. Technical Field

Embodiments of the present disclosure relate to antennas, and more particularly to a slot antenna.

2. Description of Related Art

In the field of wireless communication, the World Interoperability for Microwave Access (WiMAX) standard covers different frequency bands, such as 2.3 GHz~2.4 GHz, 2.496 GHz~2.690 GHz, 3.4 GHz~3.6 GHz and 3.6 GHz~3.8 GHz Currently, a slot antenna can cover only one frequency band of the WiMAX standard, and an impedance bandwidth with a return loss equaling −10 dB is very narrow. Various slot antennas may be required to comply with different frequency bands and expand the impedance bandwidth, increases costs of the antenna configurations. Therefore, a slot antenna that complying with different frequency bands with better impedance bandwidth is called for.

BRIEF DESCRIPTION OF THE DRAWINGS

The details of the disclosure, both as to its structure and operation, can best be understood by referring to the accompanying drawings, in which like reference numbers and designations refer to like elements.

DETAILED DESCRIPTION

All of the processes described may be embodied in, and fully automated via, software code modules executed by one or more general purpose computers or processors. The code modules may be recorded in any type of computer-readable medium or other storage device. Some or all of the methods may alternatively be embodied in specialized computer hardware or communication apparatus.

Figure 1A:
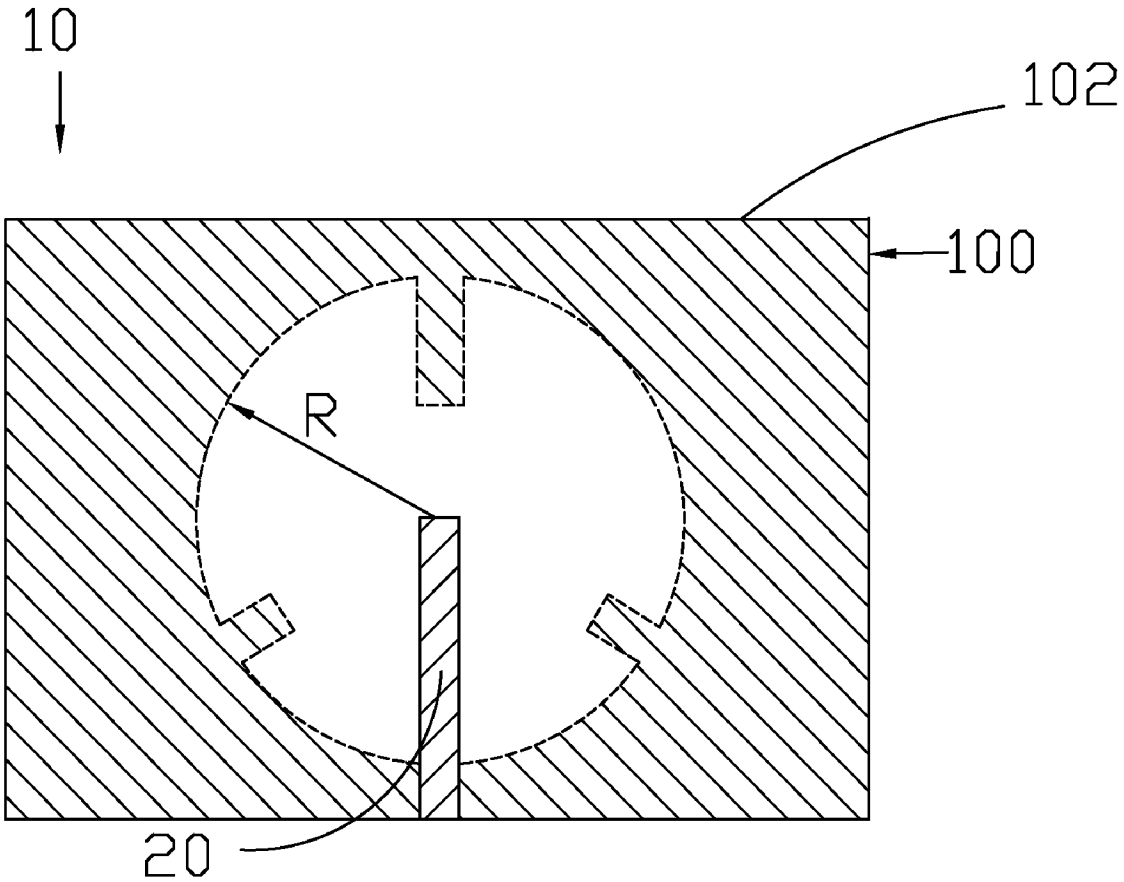
FIG. 1A and FIG. 1B are a plan view and an inverted view of one embodiment of a slot antenna of the present disclosure, respectively.
Figure 1B:
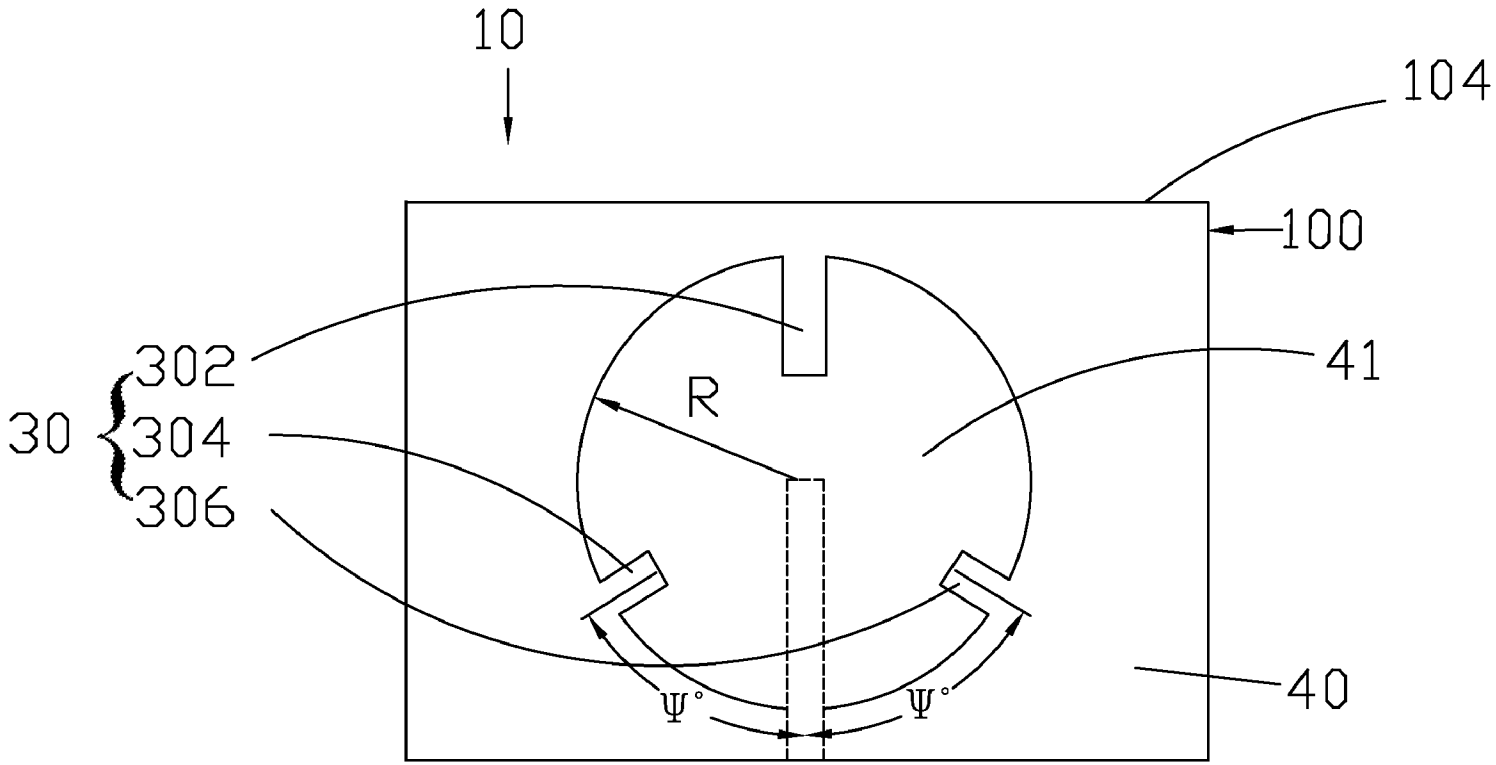

FIG. 1A and FIG. 1B are a plan view and an inverted view of one embodiment of a slot antenna 10 of the present disclosure, respectively. As shown, the slot antenna 10 is located on a substrate 100 with a first surface 102 and a second surface 104 opposite to the first surface 102, and comprises a feeding portion 20, a radiating portion 30, and a grounding portion 40.

The feeding portion 20 is located on the first surface 102, to feed electromagnetic signals.

The grounding portion 40 is located on the second surface 104 and is rectangularly-shaped. The grounding portion 40 defines a circular clearance 41 in a substantial center portion of the grounding portion 40.

In one embodiment, the feeding portion 20 is also rectangularly-shaped and extends from one side of the substrate 100 to a projection of the center of the circular clearance 41 on the first surface 102.

The radiating portion 30 is located and configured on the second surface 104 to radiate electromagnetic signals, and comprises at least one elongated microstrip (such as 302, 304 or 306) with one end connected to the grounding portion 40 and the other end extending towards the centre of the circular clearance 41. The feeding portion 20 interacts with the radiating portion so as to radiate the electromagnetic signals. In one embodiment, the radiating portion 30 comprises three elongated microstrips, such as a first radiating part 302, a second radiating part 304, and a third radiating part 306.

In one embodiment, the first radiating part 302 with one end connected to the grounding portion 40 and the other end extending towards the centre of the circular clearance 41 is also rectangularly-shaped. In one embodiment, the first radiating part 302 is parallel to the feeding portion 20, and the other end of the first radiating part 302 faces the projection of the feeding portion 20 on the second surface 104 of the substrate 100. In one embodiment, both the second radiating part 304 and the third radiating part 306 are rectangularly-shaped, each with one end connected to the grounding portion 40 and the other extending towards the center of the circular clearance 41. In one embodiment, the second radiating part 304 and the third radiating part 306 are substantially symmetrical based on a projection of the feeding portion 20 on the second surface of the substrate 104. In one embodiment, an angle (Ψ) between the second radiating part 304 and the projection of the feeding portion 20 on the second surface 104 of the substrate 100 is less than 90°, and an angle (Ψ) between the third radiating part 306 and the projection of the feeding portion 20 on the second surface 104 of the substrate 100 is less than 90°. In one embodiment, the feeding portion 20 interacts with the radiating portion 30 to radiate electromagnetic signals.

In one embodiment, the grounding portion 40 electrically connects to the radiating portion 30. An area of the circular clearance 41 subtracted from an area of the second surface 104 gives an area of the grounding portion 40. Moreover, a projection of the grounding portion 40 on the first surface 102 partially overlaps the feeding portion 20.

Figure 2:
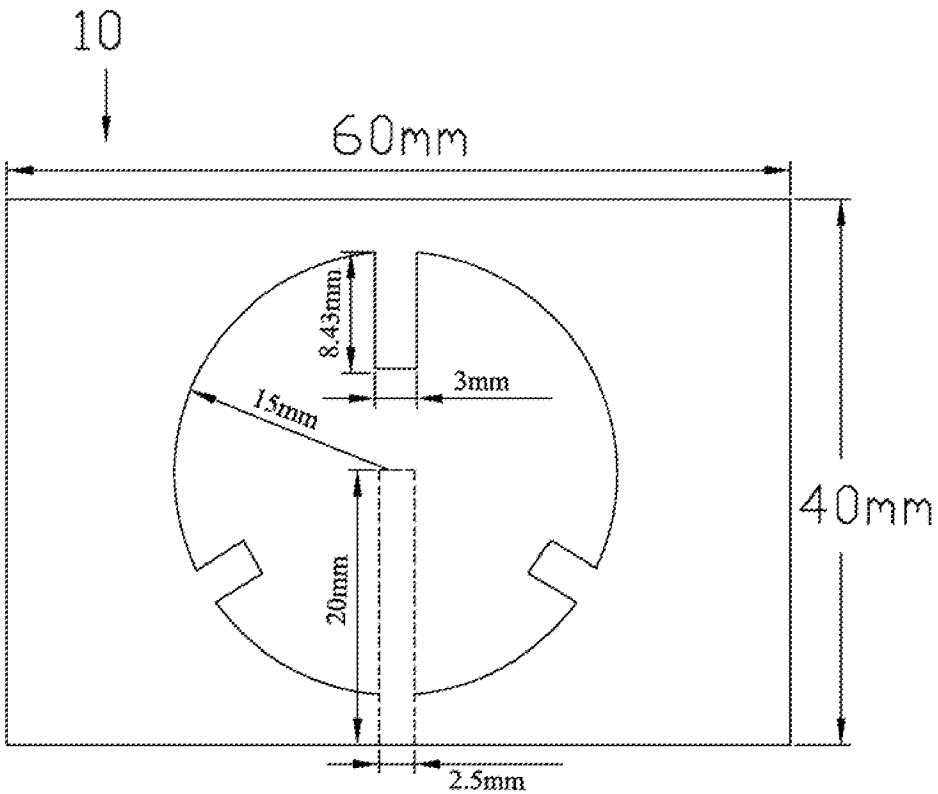
FIG. 2 illustrates exemplary dimensions of the slot antenna of FIG. 1A and FIG. 1B.

FIG. 2 illustrates exemplary dimensions of the slot antenna 10 of FIG. 1A and FIG. 1B. In one embodiment, if a wavelength of a low frequency band covered by the slot antenna 10 is $\lambda_1$, and a radius of the circular clearance 41 is R, then a perimeter of the circular clearance 41 ($2*\pi*R$) is equal to $2*\lambda_1$. If a wavelength of a high frequency band covered by the slot antenna 10 is $\lambda_2$, then a length of the first radiating part 302 is equal to a quarter of $\lambda_2$. In one embodiment, if a low frequency corresponding to a low frequency band covered by the slot antenna 10 is $f_1$, a high frequency corresponding to a high frequency band covered by the slot antenna 10 is $f_2$, then $f_2$ is less than $2*f_1$.

In one embodiment, the substrate 100 is a type FR4 circuit board, and a length and a width of the substrate 100 are equal to 60 mm and 40 mm, respectively. The radius of the circular clearance 41 R is equal to 15 mm, and a length and a width of the first radiating part 302 are equal to 8.43 mm and 3 mm, respectively. A length and a width of the feeding portion 20 equal 20 mm and 2.5 mm, respectively. In other embodiments, if the substrate 100 is a circuit board of another type, the substrate 100 will have different dimensions according to the above design theory.

Figure 3:
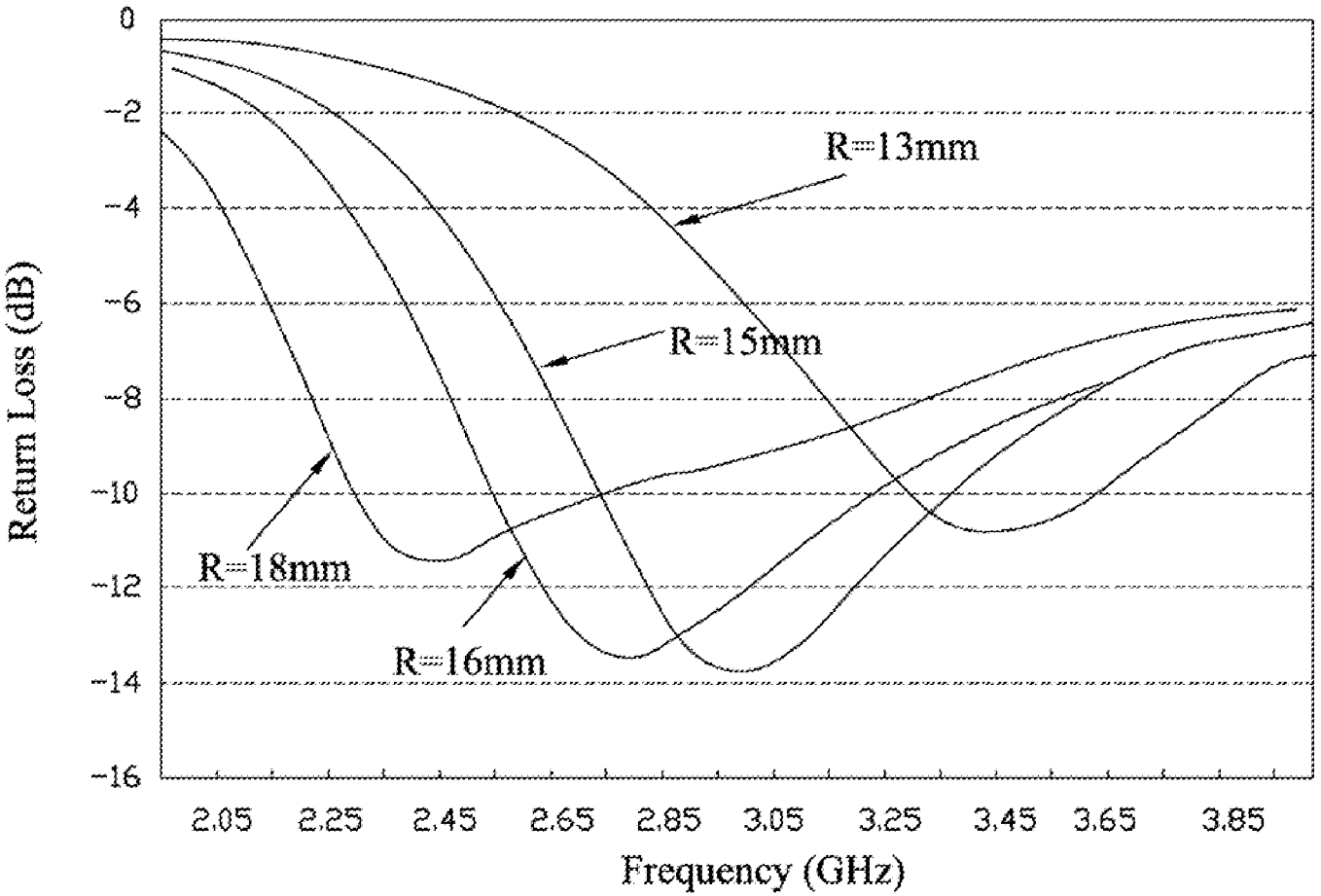
FIG. 3 is a graph showing an exemplary return loss of the slot antenna of FIG. 1A and FIG. 1B with different radius of a circular clearance and without a first radiating part, a second radiating part, and a third radiating part.

FIG. 3 is a graph showing an exemplary return loss of the slot antenna of FIG. 1A and FIG. 1B with different radiuses of the circular clearance 41 and without the first radiating part 302, the second radiating part 304, and the third radiating part 306. As shown, increased radius R of the circular clearance 41 defined by the grounding portion 40 brings the frequency band covered by the slot antenna 10 with a return loss less than −10 dB closer to the low frequency band.

Figure 4:
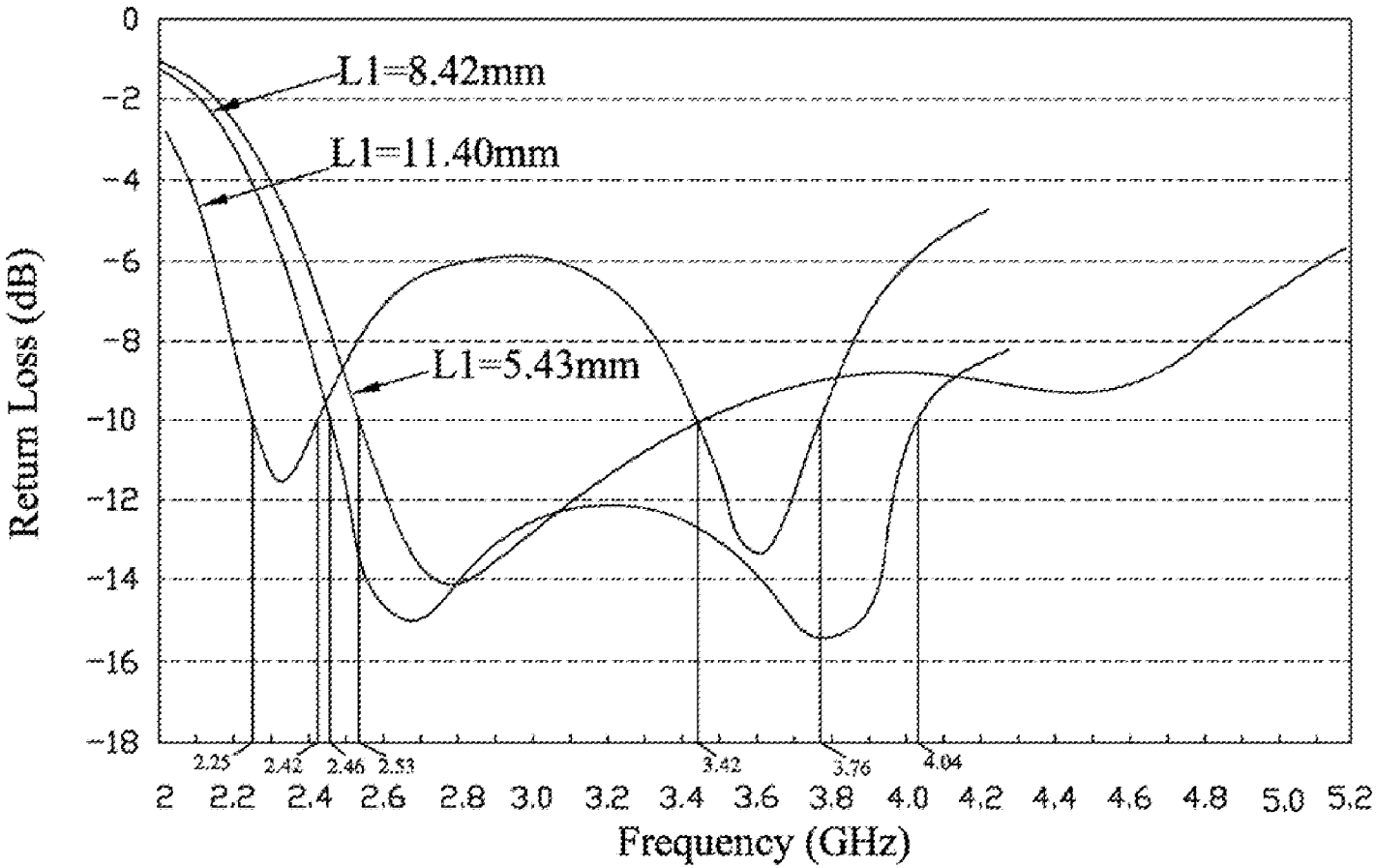
FIG. 4 is a graph showing an exemplary return loss of the slot antenna of FIG. 1A and FIG. 1B without the second radiating part and the third radiating part.

FIG. 4 is a graph showing an exemplary return loss of the slot antenna 10 of FIG. 1A and FIG. 1B without the second radiating part 304 and the third radiating part 306. As shown, when the length of the first radiating part 302 is equal to 11.40 mm, frequency bands covered by the slot antenna 10 with a return loss equaling −10 dB include 2.25 GHz~2.42 GHz and 3.42 GHz~3.76 GHz. When the length of the first radiating part 302 is equal to 8.42 mm, a frequency band covered by the slot antenna 10 with a return loss equaling −10 dB includes 2.25 GHz~2.42 GHz. When the length of the first radiating part 302 is equal to 5.43 mm, a frequency band covered by the slot antenna 10 with a return loss equaling −10 dB include 2.53 GHz~3.42 GHz. As shown, the slot antenna 10 as designed can comply with different frequency bands by changing the length of the first radiating part 302, with return loss less than −10 dB.

Figure 5:
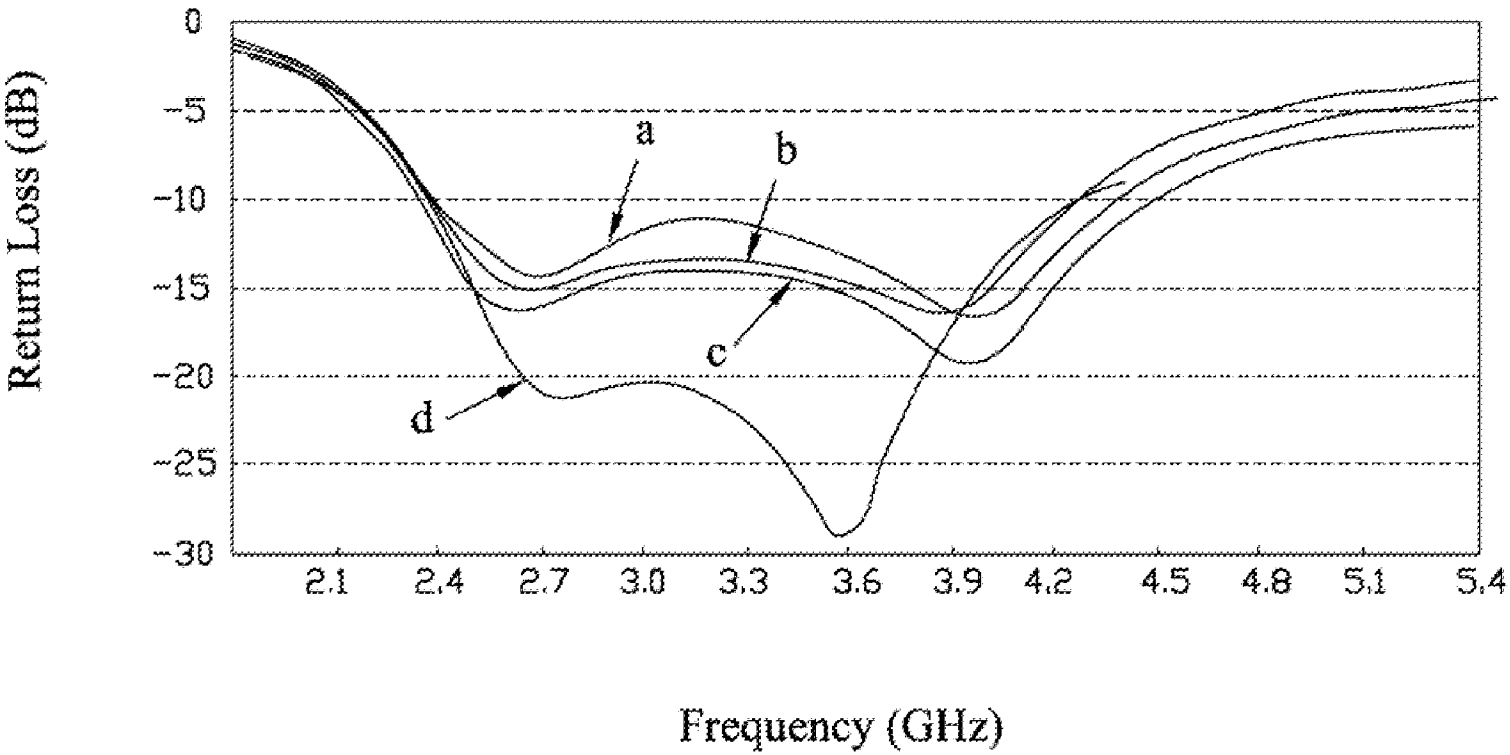
FIG. 5 is a comparison graph showing an exemplary return loss of the slot antenna 10 with a changeable length and a changeable width of the second radiating part or the third radiating part, and a changeable angle (Ψ) between the second radiating part and a feeding portion.

FIG. 5 is a comparison graph showing an exemplary return loss of the slot antenna 10 with a changeable length and a changeable width of the second radiating part 304 or the third radiating part 306, and a changeable angle (Ψ) between the second radiating part 304 and the feeding portion 20.

As shown, a curve "a" is a graph showing a return loss of the slot antenna 10 with the length and the width of the second radiating part 304 equaling 0 mm, the length and the width of the third radiating part 306 equaling 0 mm, and the angle (Ψ) between the second radiating part 304 and the feeding portion 20 equaling 0°. A curve "b" is a graph showing a return loss of the slot antenna 10 with the length of the second radiating part 304 and the third radiating part 306 equaling 3.43 mm, the width of the second radiating part 304 and the third radiating part 306 equaling 3.00 mm, the angle (Ψ) between the second radiating part 304 and the feeding portion 20 equaling 60°. A curve "c" is a graph showing a return loss of the slot antenna 10 with the length of the second radiating part 304 and the third radiating part 306 equaling 3.47 mm, the width of the second radiating part 304 and the third radiating part 306 equaling 2.00 mm, the angle (Ψ) between the second radiating part 304 and the feeding portion 20 equaling 30°. A curve "d" is a graph showing a return loss of the slot antenna 10 with the length of the second radiating part 304 and the third radiating part 306 equaling 6.47 mm, the width of the second radiating part 304 and the third radiating part 306 equaling 2.00 mm, the angle (Ψ) between the second radiating part 304 and the feeding portion 20 equaling 30°.

As shown, the curve "b", the curve "c" and the curve "d" have lower return loss than the curve "a", indicating that return loss can be reduced by setting the second radiating part 304 and the third radiating part 306. Compared with the curve "c", the curve "d" shows lower return loss, providing reduced return loss by adding the length of the second radiating part 304 and the third radiating part 306.

In one embodiment, return loss can be reduced greatly by setting the second radiating part 304 and adding the length of the second radiating part 304 according to the specific return loss requirements.

Figure 6:
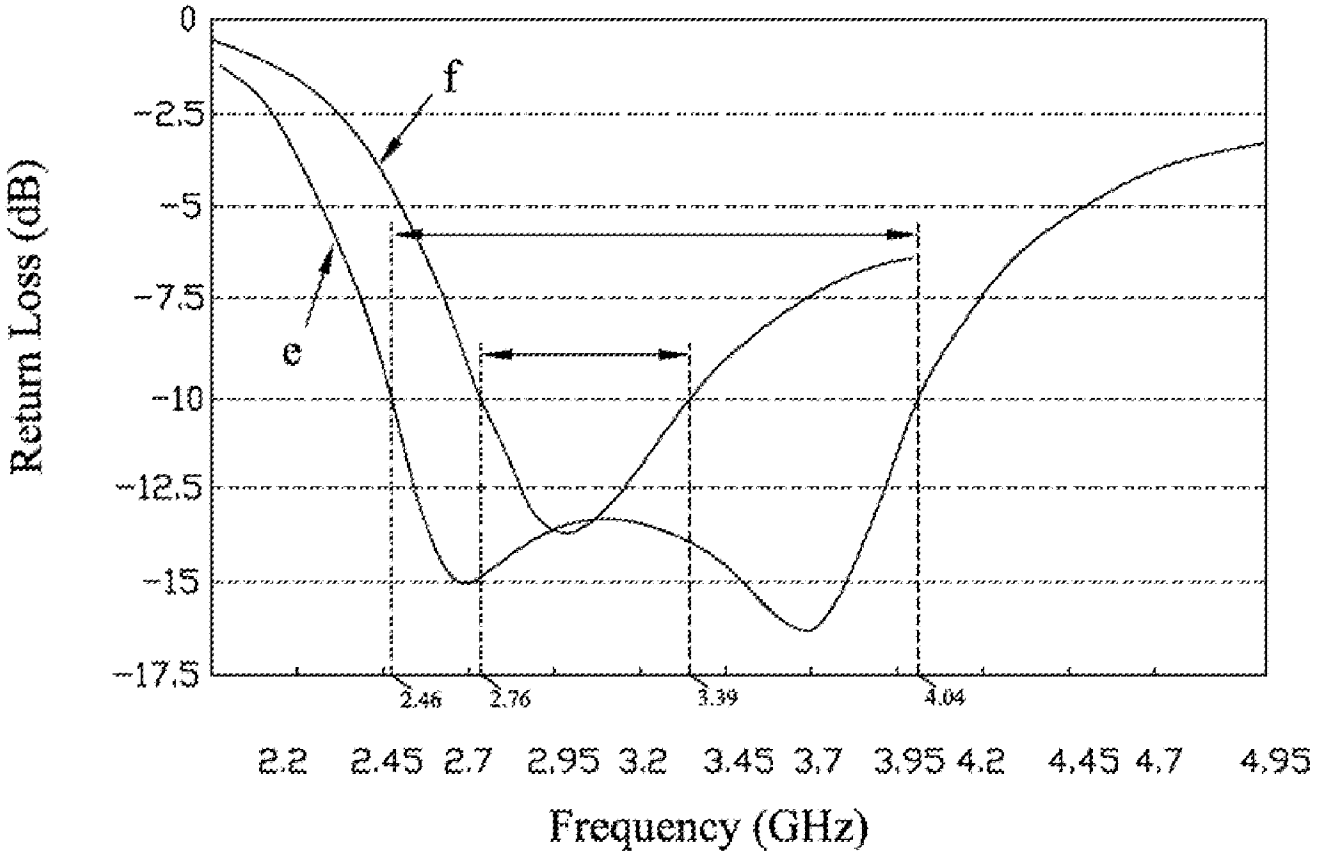
FIG. 6 is a comparison graph showing an exemplary return loss of the slot antenna of FIG. 1A and FIG. 1B.

FIG. 6 is a comparison graph showing an exemplary return loss of the slot antenna of FIG. 1A and FIG. 1B. A curve "e" (the same as the curve "b" in FIG. 5) is a graph showing a return loss of the slot antenna 10 with the first radiating part 302, the second radiating part 304 and the third radiating part 306. A curve "f" is a graph showing a return loss of the slot antenna 10 without the first radiating part 302, the second radiating part 304, and the third radiating part 306.

As shown, a frequency band covered by the curve "e" of a return loss less than −10 dB is 2.46 GHz~4.04 GHz, that is, a high frequency ($f_H$) is equal to 4.04 GHz, a low frequency ($f_L$) is equal to 2.46 GHz, and a centre frequency ($f_c$) is equal to ($f_L+(f_H-f_L)/2$). Accordingly, an impedance bandwidth (BW) is equal to $(f_H-f_L)/f_c$, and equal to 48.6% after calculating. Homogeneously, a frequency band covered by the curve "f" of a return loss less than −10 dB is 2.76 GHz~3.39 GHz, that is, a high frequency ($f_H'$) is equal to 3.39 GHz, a low frequency ($f_L'$) is equal to 2.76 GHz, and a centre frequency ($f_c'$) is equal to ($f_L'+(f_H'-f_H')/2$), accordingly, an impedance bandwidth (BW') is equal to $(f_H'-f_L'$, and equal to 20.4% after calculating. Compared with the value of BW and BW', BW exceeds BW', showing specific impedance bandwidth (BW) requirements met by setting the first radiating part 302, the second radiating part 304 and the third radiating part 306.

In one embodiment, the slot antenna 10 can not only cover more frequency bands, but also reduce return loss greatly and extend the impedance bandwidth (BW) greatly to meet specific requirements by setting the first radiating part 302, the second radiating part 304 and the third radiating part 306 or changing the length and the width thereof.

While various embodiments and methods of the present disclosure have been described, it should be understood that they have been presented by example only and not by limitation. Thus the breadth and scope of the present disclosure should not be limited by the above-described embodiments, but should be defined only in accordance with the following claims and their equivalents.

What is claimed is:

1. A slot antenna located on a substrate with a first surface and a second surface opposite to the first surface, the slot antenna comprising:

a feeding portion located on the first surface of the substrate, to feed electromagnetic signals;

a rectangular grounding portion located on the second surface of the substrate, defining a circular clearance in a substantial center portion thereof; and a radiating portion located on the second surface of the substrate and comprising at least one elongated microstrip with one end connected to the grounding portion and the other end extending towards the center of the circular clearance;

wherein the feeding portion interacts with the radiating portion so as to radiate the electromagnetic signals.

2. The slot antenna as claimed in claim 1, wherein the feeding portion is rectangularly-shaped and extends from one side of the substrate to a projection of the centre of the circular clearance on the first surface.

3. The slot antenna as claimed in claim 2, wherein the radiating portion comprises:

a first radiating part with one end connected to the grounding portion and the other end extending towards the centre of the circular clearance, and parallel to the feeding portion; and a second radiating part and a third radiating part, each with one end connected to the grounding portion and the other end extending towards the center of the circular clearance, wherein the second radiating part and the third radiating part are substantially symmetrical based on a projection of the feeding portion on the second surface of the substrate.

4. The slot antenna as claimed in claim 3, wherein the other end of the first radiating part faces the projection of the feeding portion on the second surface of the substrate.

5. The slot antenna as claimed in claim 4, wherein an angle between the second radiating part and the projection of the feeding portion on the second surface of the substrate is less than 90°, and an angle between the third radiating part and the projection of the feeding portion on the second surface of the substrate is less than 90°.

6. The slot antenna as claimed in claim 3, wherein a length of the first radiating part is equal to a quarter of a wavelength of a high frequency band covered by the slot antenna.

7. The slot antenna as claimed in claim 1, wherein the substrate is a type FR4 circuit board.

8. The slot antenna as claimed in claim 1, wherein a perimeter of the circular clearance is twice as long as a wavelength of a low frequency band covered by the slot antenna.

9. The slot antenna as claimed in claim 1, wherein a high frequency corresponding to a high frequency band covered by the slot antenna is less than twice a low frequency corresponding to a low frequency band covered by the slot antenna.

* * * * *